United States Patent [19]

Brannan et al.

[11] 4,318,612

[45] Mar. 9, 1982

[54] HOT ROLL FUSER TEMPERATURE CONTROL

[75] Inventors: Robert C. Brannan, Longmont; Robert J. Fogoros, Boulder; Michael R. Headrick, Boulder; Ainis Krumins, Erie; Robert F. Pryor, Boulder, all of Colo.

[73] Assignee: International Business Machines Corporation, Armonk, N.Y.

[21] Appl. No.: 168,825

[22] Filed: Jul. 10, 1980

[51] Int. Cl.[3] ..... G03G 15/00

[52] U.S. Cl. ..... 355/14 FU; 219/216; 355/3 FU; 355/30

[58] Field of Search ..... 355/14 FU, 3 FU, 30; 219/216, 388, 490, 492, 494

[56] References Cited

U.S. PATENT DOCUMENTS

| | | | |
|---|---|---|---|
| 3,532,855 | 10/1970 | Van Cleave | 355/3 FU |
| 3,553,429 | 1/1971 | Nelson | 219/497 |
| 3,558,853 | 1/1971 | Schluntz | 219/216 |
| 3,705,289 | 12/1972 | Szostak et al. | 219/216 |
| 3,809,855 | 5/1974 | Neal | 219/216 |
| 3,832,524 | 8/1974 | Takiguchi | 219/216 |
| 3,881,085 | 4/1975 | Traister | 219/216 |
| 3,910,570 | 10/1975 | Bleau | 271/245 |
| 3,926,519 | 12/1975 | Rebres | 219/216 X |
| 3,937,921 | 2/1976 | Furuichi et al. | 219/494 |
| 3,946,199 | 3/1976 | Nakamura | 219/499 |
| 3,985,433 | 10/1976 | Calvi | 355/3 R |
| 4,006,985 | 2/1977 | Hutner | 355/14 FU |
| 4,046,990 | 9/1977 | White | 219/471 |
| 4,053,733 | 10/1977 | Murata et al. | 219/494 |
| 4,078,166 | 3/1978 | Kitamura et al. | 219/216 |
| 4,109,134 | 8/1978 | Van Herten | 219/216 |
| 4,145,599 | 3/1979 | Sakurai et al. | 219/216 |
| 4,154,575 | 5/1979 | Edwards et al. | 432/60 |
| 4,170,414 | 10/1979 | Hubert et al. | 355/14 |

*Primary Examiner*—R. L. Moses
*Attorney, Agent, or Firm*—Francis A. Sirr

[57] ABSTRACT

The temperature of a hot roll xerographic fuser is controlled by a control system which compares a command set point temperature to the fuser's actual temperature and energizes a fuser heater accordingly. A cold start of the fuser is distinguished from a warm start, and the command set point temperature is magnitude-programmed accordingly.

10 Claims, 9 Drawing Figures

HOT ROLL FUSER TEMPERATURE CONTROL

TECHNICAL FIELD

The present invention relates to the field of xerographic reproduction devices having a hot roll fusing station, and to the temperature control of such a fusing station.

BACKGROUND OF THE INVENTION

As is well known, one form of xerographic reproduction device uses dry, particulate toner which is heat fused to paper to form a permanent image, usually black in color, on one or both sides of the paper.

A widely used heat fuser is a hot roll fuser. In this type of fuser the sheet of paper to be fused passed through the pressure nip formed by two rollers, usually cylindrical, which are in pressure contact. The quality of fusing produced by such a fuser is a function of temperature, time and pressure.

The pressure parameter is a function of the general construction of the hot roll fuser.

The time parameter is a function of the rotational speed of the fuser roll and the width of the fusing nip, this width being measured in the direction of paper movement. The width of the fusing nip is a function of the construction of the rolls. Hot roll fusers usable with the present invention may have any of the known construction, for example a soft heated roll and a hard unheated roll such as shown in U.S. Pat. No. 4,154,575, incorporated herein by reference.

The present invention is specifically related to a temperature control system for a hot roll fusing station, and while it will be explained in the environment of the hot roll fuser of U.S. Pat. No. 4,154,575, i.e. a fusing station having a soft hot roll and a hard, cold backup roll, it is not to be limited thereto.

The prior art has recognized the need to accurately control the temperature of a hot roll fusing station. In exemplary prior art a temperature control system includes an electrically energizable heater which is controlled by an electrical or electronic network which compares actual fuser temperature to a command set point temperature. The output of this network operates, in one manner or another, to energize the heater so as to cause the actual temperature to substantially achieve the set point temperature.

The means by which the fusing station's actual temperature has been sensed in the prior art includes a variety of specific constructions, and the selection of a specific construction to perform this function in the fuser temperature control system of the present invention is not critical thereto. In the preferred embodiments of the present invention the temperature sensing means is that shown in U.S. Pat. No. 3,809,855, incorporated herein by reference. However, the present invention is not to be limited thereto.

The use of a thermistor temperature sensing bridge circuit and a differential amplifier to control electrical energization of a heater is well known, as shown for example in U.S. Pat. No. 3,553,429.

In U.S. Pat. No. 3,705,289 an arrangement of this general type is shown in copying equipment where safety protection is provided should the resistance of the temperature varying resistor become too low (short circuit) or too high (open circuit).

U.S. Pat. No. 3,946,199 again shows this general arrangement in a copier. Here, the copier is maintained not-ready for use, after copier turn on, until an intermediate fuser temperature is sensed, whereupon the copier can be used as the fuser's temperature is maintained at a higher temperature. At the end of copier use, when the copier is turned off, a fan operates to cool the fuser until its temperature is sensed to be a temperature which is below the temperature at which the initial not-ready to ready transition occurred.

U.S. Pat. No. 3,985,433 also deals with maintaining a copying machine not-ready until a fuser enclosure heats up.

In U.S. Pat. No. 4,046,990, a hot roll fuser's silicone rubber covered heated roll has its temperature sensed by means of a temperature sensor 5 which is located in direct contact with an underlying metal core. An on-off or proportional controller 6 receives its input from the sensor, under the control of control logic, in response to certain information such as warm-up condition, copy start and/or copy stop control. The controller's output controls energization of a heater located within the heated roll. The fuser's temperature is maintained at an idling temperature setting, and is changed to a higher temperature upon the control logic indicating that copies will be forthcoming. In order to reduce the amplitude and duration of a fuser temperature overshoot, after a copy run state has been completed, it is said that the machine logic can be designed to cooperate with copy counters to cause the controller to control at the idle state temperature just prior to the end of the copy run.

In U.S. Pat. No. 4,145,599 a hot roll fuser temperature control system is suggested where four fuser temperatures are possible. The highest of these temperatures is that used for making copies. A lower temperature is a standby temperature which occurs when no copying operation is in effect, but the copier is ready for copying. In the event that a standby period is preceded by a long copy run, the fuser is maintained at a temperature which is lower than the above-mentioned standby temperature. This temperature is maintained for a time dependent upon the length of the copy run, whereupon the temperature returns to the higher standby temperature. The last of these four temperatures is the lowest of the four, and is the temperature below which the copier is maintained not-ready.

SUMMARY OF THE INVENTION

Two basically different operating environments may occur when a copier is initially turned on. In the more usual situation, the copier has been in an off state for an extended period of time, such as overnight. Upon the copier being turned on, all components of the fusing station are at a cool, room-ambient temperature. In another situation, the copier has been turned off for only a short time, as might occur for a variety of reasons. In this latter situation, the various fuser station components are usually still relatively hot when the copier is turned on.

The present invention provides a temperature control system which distinguishes a true cold start from a relatively hot start, and controls the fuser's temperature set point or command temperature, accordingly. More specifically, a higher set point is instituted for a true cold start, and as a further feature of the present invention the reproduction device is maintained not ready until this higher set point is achieved, or is substantially achieved.

As yet a further feature of the present invention, once the device enters its ready state, the fuser's temperature set point is controlled in accordance with the area of the sheet to be fused. As yet a further feature, use of a larger area sheet produces a higher fuser temperature set point, and this set point temperature is reduced at measured intervals before the end of the larger area sheet reproduction job.

In the event that a cold start is experienced, the present invention provides for the possibility of more than one operating mode, such as a higher standby set point temperature for a period of time after such a cold start and after the device becomes ready for reproduction use. In the event that the power-on event is not a cold start, this higher standby set point temperature is not used.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
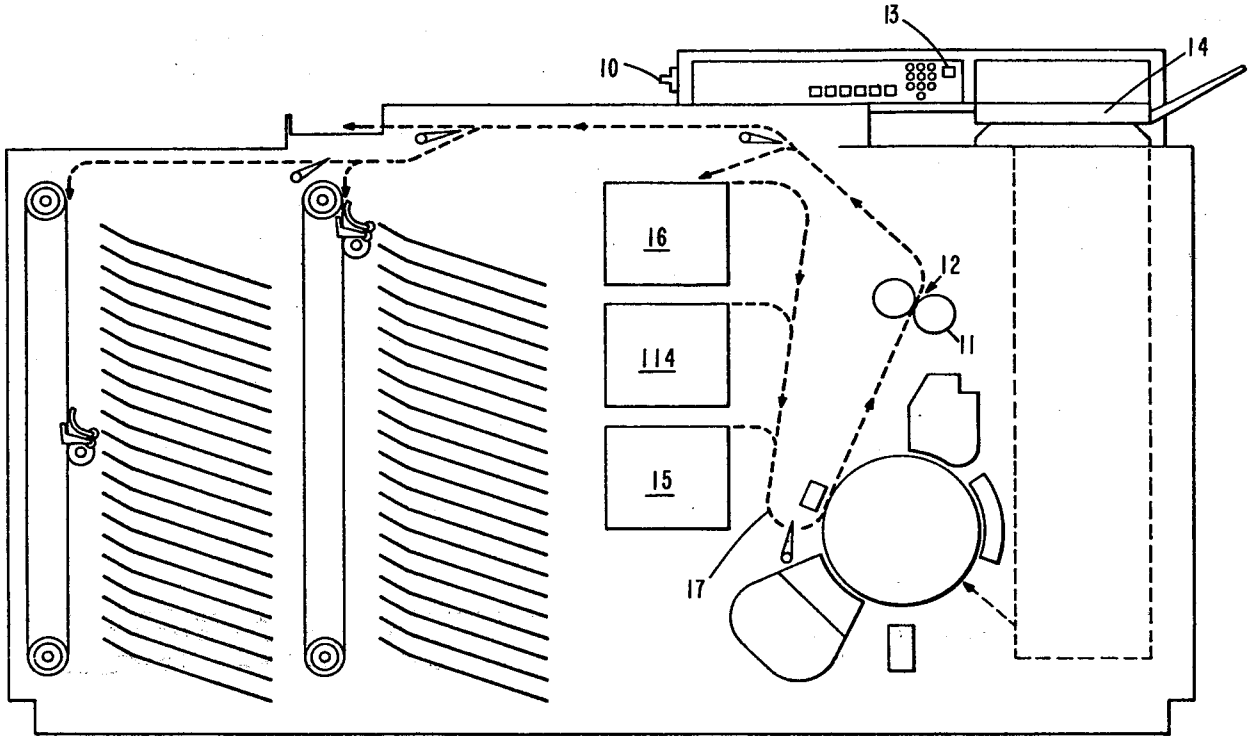
FIG. 1 is a copier incorporating the present invention.

FIG. 1 discloses a copier incorporating the present invention. As is usual with such a copier, a main power cord (not shown) is continuously connected to a source of alternating current of the well known variety. The copier's control panel includes a main on-off switch 10. At the end of a working day, it is usual practice to turn off switch 10, whereupon all, or at least a majority of the copier's internal components are deenergized. In every known situation, the heater of the copier's hot roll fuser 11 is deenergized when switch 10 is turned off.

The morning of the next working day requires the key operator to turn the copier on. This event is defined as a POR event, i.e. an off-to-on transition of switch 10. Immediately, the copier's control panel displays a "not ready" or "please wait" signal. The copier now enters a state of operation during which the copier readies itself for use. This period usually lasts no more than ten minutes and includes heating of the hot roll fuser, usually from a room-ambient temperature to an operating temperature in excess of 300° F. After a wait period of about ten minutes, the copier becomes ready for use and enters a standby period. Thereafter, the copier can be used in the usually well known fashion, either by manual operation of button 13, or by the entry of an original document into document feeder 14. This document feeder is of the semiautomatic type, for example the document feeder of U.S. Pat. No. 3,910,570 or U.S. Pat. No. 4,170,414, both of which are incorporated herein by reference.

During regular use, it may be necessary to turn off switch 10 for a short time period, and for a variety of reasons. When switch 10 subsequently makes its off-to-on transition, the copier will immediately assume a not-ready state. However, this is not a true fuser cold start, and the copier assumes its ready state in a relatively short time period of say one or two minutes.

The copier of FIG. 1 is, for example, the IBM Series III copier/duplicator wherein one paper bin 114 holds letter size paper, whereas bin 15 holds legal size paper. Bin 16 facilitates duplex copying. As can be readily appreciated, these two papers, of small and large areas, require corresponding different quantities of heat when passing through fuser 12. As will be apparent, the knowledge of the size sheet to be fused is used to advantage in this invention to control the sheet to be fused. For example, stack guides within trays 114 and 15, which are set by the operator when paper is loaded into the trays, may include size transducers; or the portion 17 of the sheet path may include sensors to sense the size of each sheet, on the fly, as the sheet moves through portion 17; or paper size buttons, either on the control panel or adjacent the paper bins, may be provided to be actuated by the operator to indicate the size paper in use.

Figure 4:
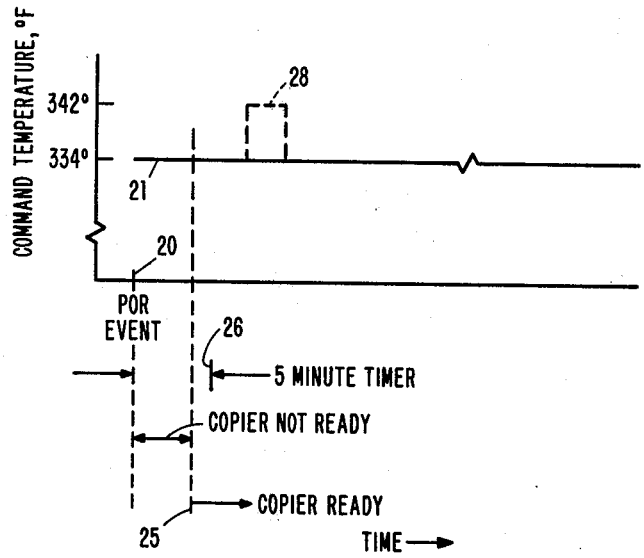
Figure 5:
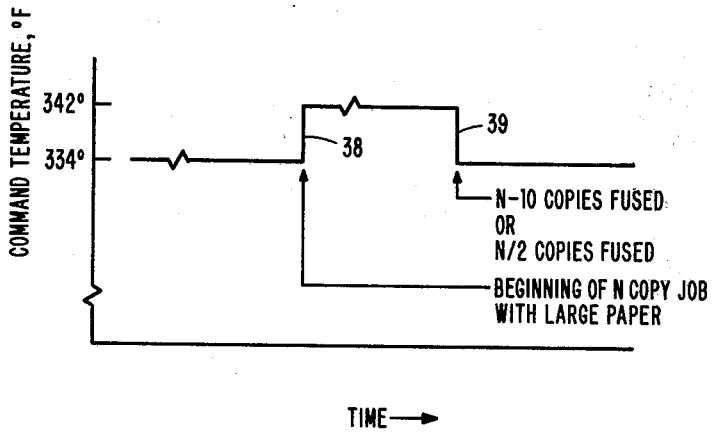
Figure 6:
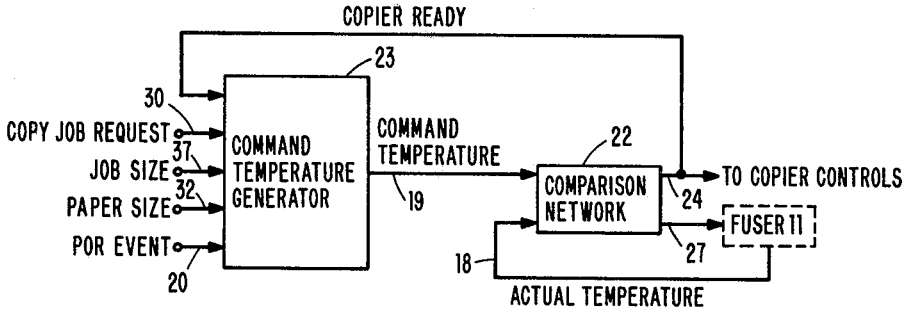
FIG. 6 is a generic control system for implementing the operating modes of FIGS. 2–5.

The basic concepts of the present invention can be understood by reference to FIGS. 2–6, and the breadth of this invention is considered to include all means to implement the concepts disclosed by these figures. In FIGS. 2–5 the command control point temperature setting for the fuser's comparison network means (FIG. 6), which energizes the heater within the hot roll 11 of FIG. 1's hot roll fuser 12, is plotted as a function of time. This comparison network means can take a wide variety of forms including discrete components such as differential amplifiers, temperature sensitive bridge circuits, discrete logic components, and microcomputers. Whatever form, in its basic operation the comparison network means operates to compare the actual temperature 18 (FIG. 6) of fuser 12 to the then-operative control point temperature 19, also called the command temperature. If the actual temperature is lower than the command temperature, the fuser's heater is energized in a manner best suited to achieve the command temperature in a short time interval, but without excessive overshoot by the fuser's actual temperature. A variety of control schemes are known to those of skill in the art which minimize both time and overshoot in such an operating environment and the use of a specific known scheme is not critical to the present invention. FIG. 6 is one such control system.

Figure 2:
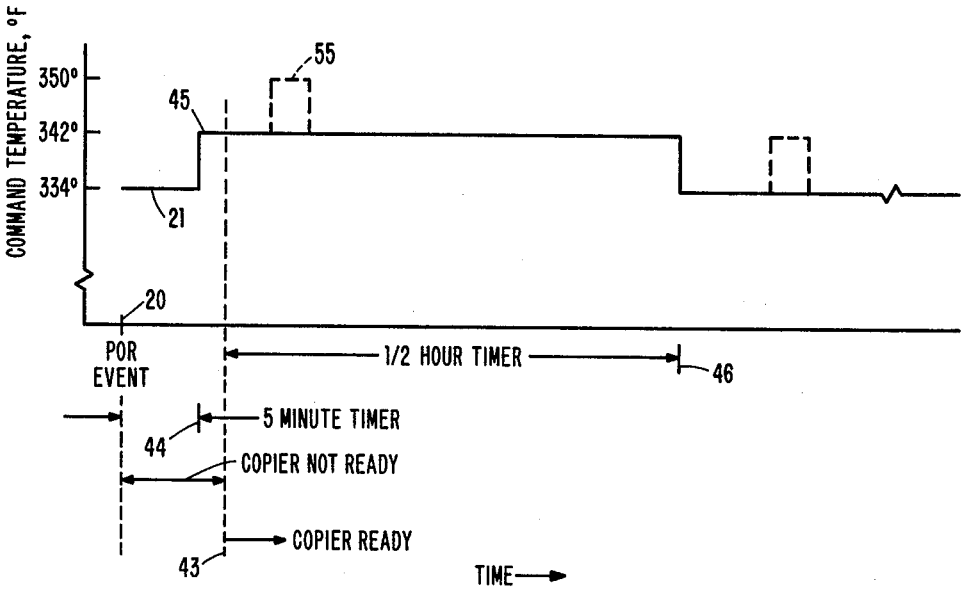
FIGS. 2–5 graphically depict the various operating modes of the present invention.
Figure 3:
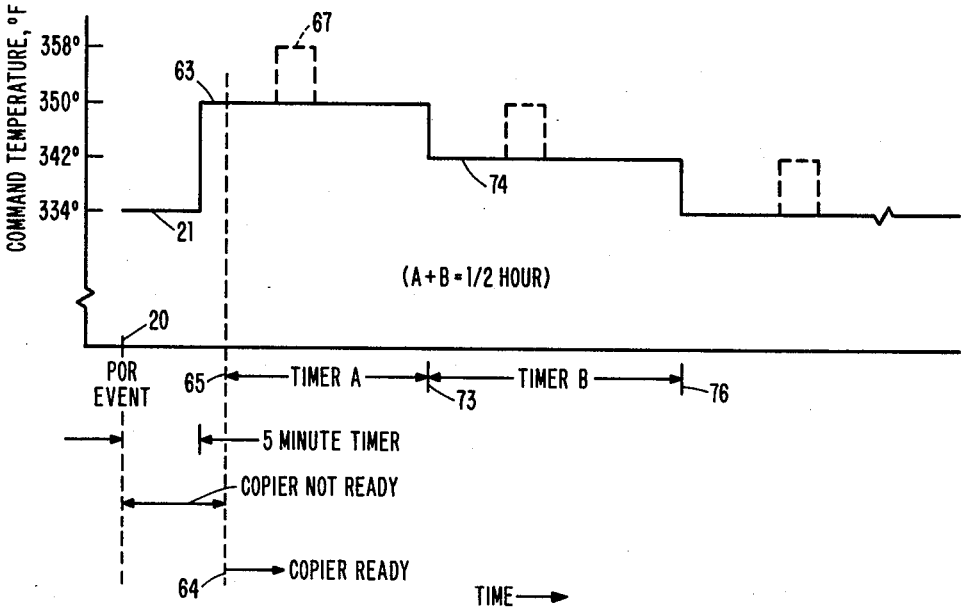

FIGS. 2 and 3 define alternative embodiments of the present invention. In both of these embodiments, POR event 20 (also shown in FIGS. 4 and 7) causes a command temperature 21 (19 of FIG. 6), of an exemplary 334° F., to be set for FIG. 6's comparison network 22. At this time, the overall control system of FIG. 6, and particularly command temperature generator 23, does not know if this POR event is a true cold start, or merely a momentary interruption of power, such as implemented by relatively quick off-on actuation of switch 10, for example.

In accordance with the present invention, generator 23 now begins to monitor how long it takes to cause the fuser's actual temperature 18 to increase to about the command temperature of 334°. For example, generator 23 includes a five-minute timer which starts counting or timing upon the occurrence of POR event 20.

Two sequence of events can now occur. If this POR event is a true cold start, FIG. 6's copier ready signal 24 will occur only after five minutes have expired. If this event is not a true cold start, signal 24 occurs before this timer times-out.

FIG. 4 shows what occurs when the event is not a cold start. Here it is seen that copy ready signal 24 occurs at time 25, which is before the timer times-out at time 26. When this occurs, command temperature 21 of exemplary 334° F. is maintained and output 27 of comparison network 22 cycles on and off to maintain fuser 11 at this operating temperature.

As a further feature of the present invention, as expressed by FIG. 4, small-area, letter size paper is fused at this command temperature of 334° F., and larger-area, legal size paper is fused at an exemplary command temperature 28 of 342° F.

Figure 8:
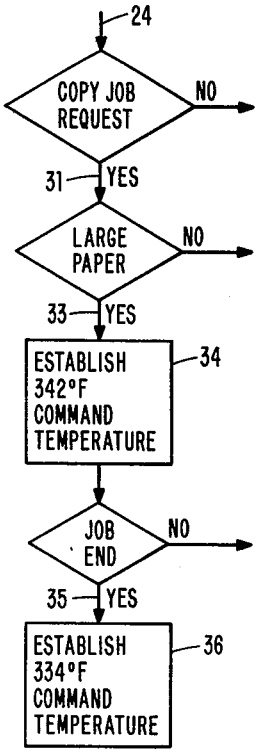
FIGS. 7–9 are control flow charts enabling one skilled in the art to implement the various operating modes of FIGS. 2–5 with a variety of specific control systems, such as that of FIG. 6.

FIG. 8 shows this FIG. 4 mode of operation. As is conventional, a copy job request (signal 30 of FIG. 6) will not be honored until copy-ready signal 24 is active. Thereafter, the presence of a copy job request (31 of FIG. 8) implements an inquiry as to the use of small paper or large paper. As above mentioned, a small paper copy job does not result in a change in the magnitude of FIG. 6's command temperature. When the use of large paper is indicated by FIG. 6's signal 32 (33 of FIG. 8), command temperature 19 of FIG. 6 is increased to 342° F. (34 of FIG. 8), and the copy job proceeds. At the end of the copy job (35 of FIG. 8), the command temperature is restored to 334° F. (36 of FIG. 8).

As a further feature of the present invention, the term "job end", may in fact be an anticipation of the actual job end, as shown in FIG. 5. FIG. 6's job size signal 37 provides the job size number N to generator 23 at time 38, this being the beginning of a copy job using large paper. As a result, the command temperature immediately increases to 342° F., as above described. At time 39, N copies have not actually been fused by fuser 11, and yet the command temperature for the fuser is lowered to 334° F. The exact manner of selecting time 39 is critical but not unique. A useful example is that if N is less than 20 copies, time 39 occurs when about one-half of N copies have been fused. When N is greater than 20 copies, time 39 occurs when N-10 copies have been fused.

The above-described anticipation of the end of a copy job is not implemented if another document to be copied is detected in a standby position in the entry tray of FIG. 1's semiautomatic document feed 14. It is only on the last of such a series of documents, which are fed by way of this entry tray, that the end of the copy job is anticipated as above described.

Having described the mode of operation where POR event 20 does not signal a cold start, the occurrence of a true cold start will now be described with reference to FIG. 2. Here it is seen that copy-ready signal 24 occurs at time 43, which is after the timer times-out at time 44. FIG. 6's generator 23 recognizes this fact at time 44 and at that time institutes a 342° F. command temperature, as indicated at 45.

A time thereafter, usually a few minutes, the copier becomes ready for use. Event 43 is recognized by generator 23 and a one-half hour timer begins to operate. At time 46 this timer times-out and FIG. 6's command temperature 19 is lowered to 334° F. Thereafter, the mode of operation is that of FIG. 8 above described.

Figure 7:
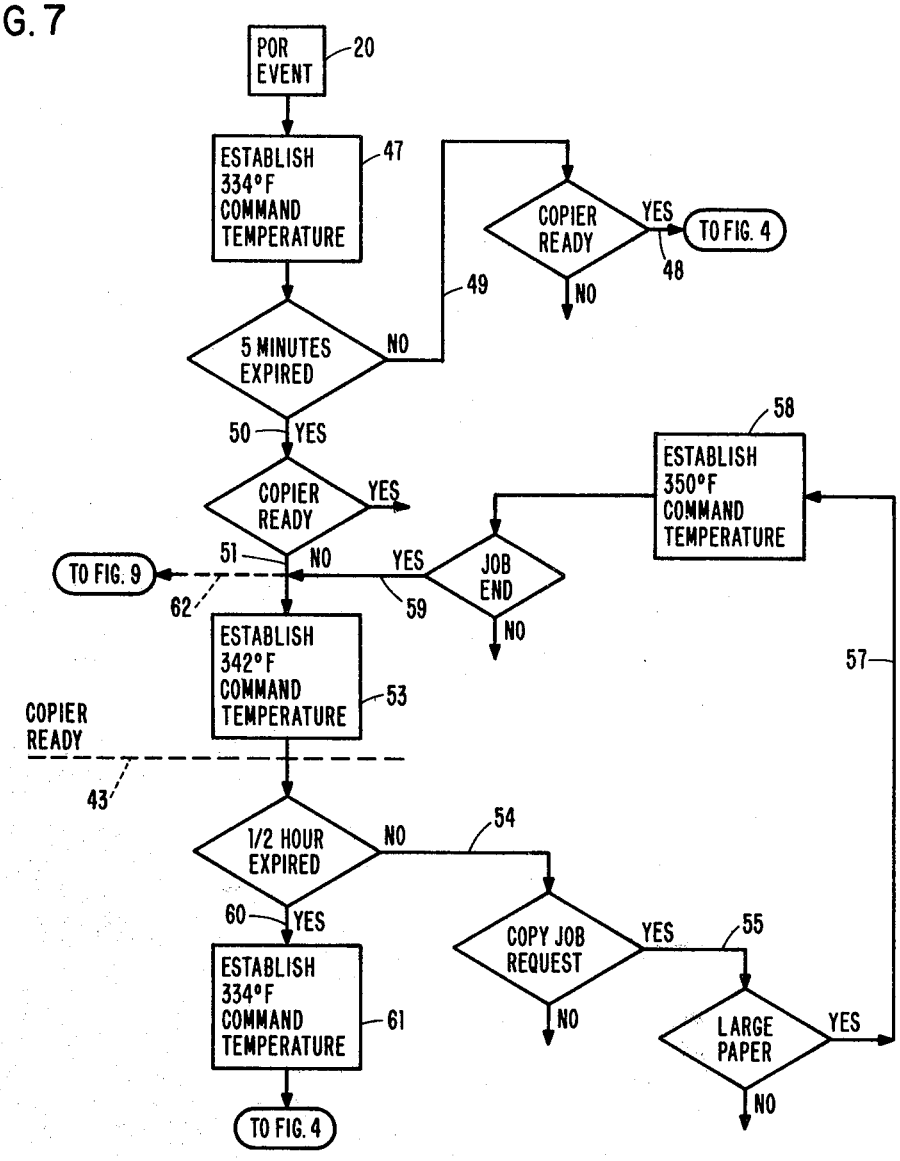
Figure 9:
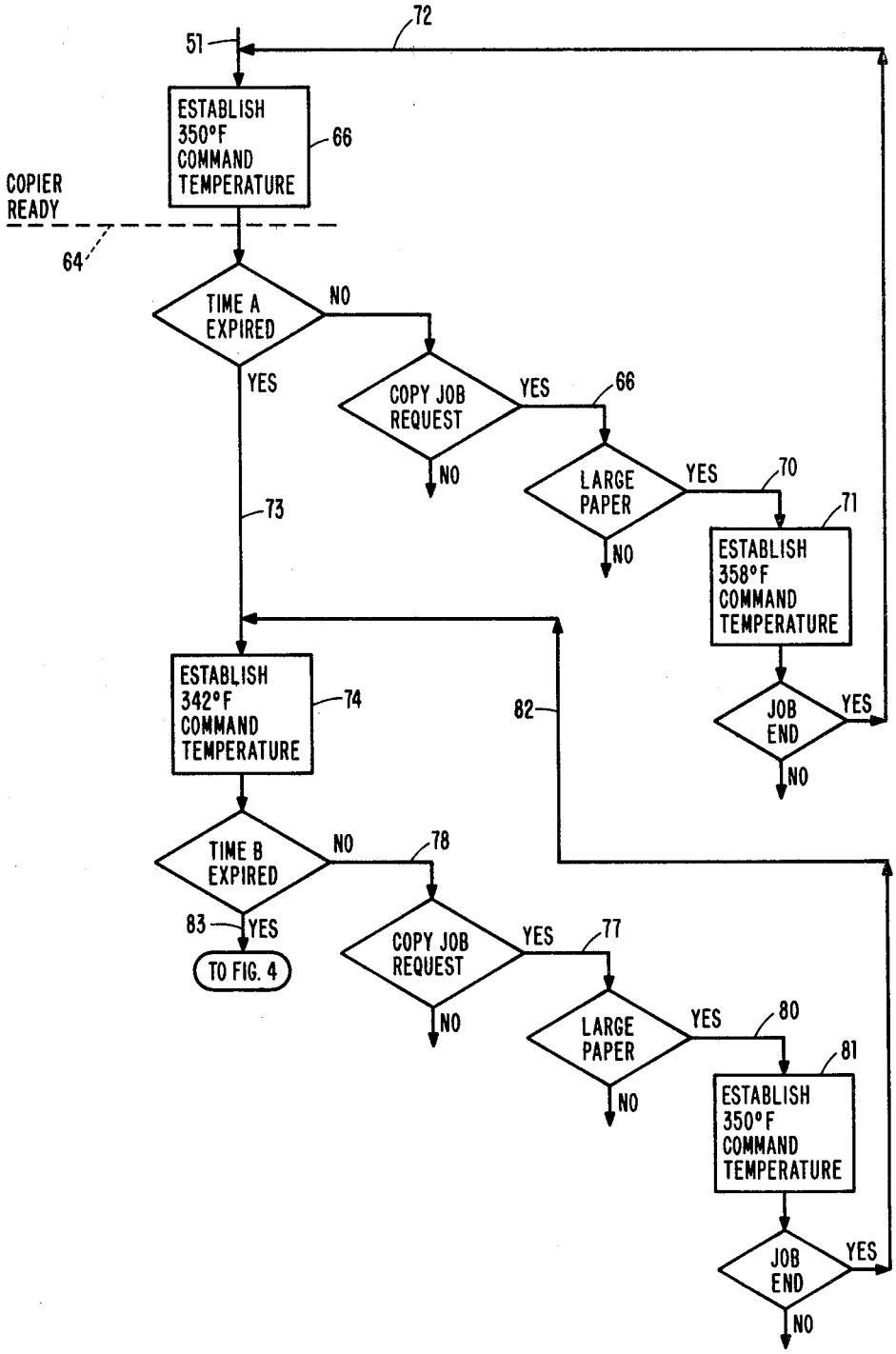

FIG. 7 will now be used to describe this one-half hour mode of operation in greater detail. As seen, POR event 20 initially establishes the command temperature at 334° F., as seen at 47. As above described, if the copier becomes ready (48) before the five-minute timer times-out (49), the mode of operation of FIGS. 4, 8, and 9 is implemented.

On a cold start, however, this timer times-out (50) before ready signal 24 occurs (51). A command temperature of 342° F. is now implemented at FIG. 2's time 44, as seen at 53 of FIG. 7. Later, at time 43 the copier becomes ready.

So long as the one-half hour timer has not timed-out (54 of FIG. 7) a copy job request 55 is produced at the command temperature of 342° F. for small paper (i.e. no change in FIG. 6's command temperature 19 occurs), or at the command temperature of 350° F. for large paper (55 of FIG. 2).

Assuming large paper is to be used for the copy job before the one-half hour timer times-out (57 of FIG. 7), the command temperature is increased to 350° F. as indicated at 58. At the job's end 59 the command temperature of 342° F. is reinstated.

As soon as the one-half timer times-out, 60 of FIG. 7, the command temperature is lowered to 334° F. as indicated at 61, and thereafter the mode of operation is that of above-described FIGS. 4 and 8.

FIGS. 3 and 9 represent an embodiment of the present invention wherein the one-half hour time interval of FIGS. 2 and 7 is partitioned into times A and B of time intervals which are not critical, just as the one-half hour time interval of FIG. 2 is not critical to the present invention. Reference numeral 62 of FIG. 7 shows how the FIGS. 3 and 9 embodiment is achieved.

More specifically, when a true cold start occurs, FIG. 7's event 51, also shown in FIG. 9, causes command temperature 19 of FIG. 6 to increase to 350° F., as seen at 63 of FIG. 3 and 66 of FIG. 9.

Some time thereafter, at time 64 of FIGS. 3 and 9, the copier becomes ready and timer A starts timing, as shown at 65.

If a copy job request is received before timer A times-out, as at 66 of FIG. 9, the copy job is fused at command temperature 63 of 350° F. for small paper or at command temperature 67 of 358° F. for large paper.

When large paper is in use, 70 of FIG. 9, the command temperature for FIG. 6's network 22 is increased to 358° F., as indicated at 71 of FIG. 9. At the job's end 72, the command temperature returns to 350° F.

At time 73 of FIGS. 3 and 9, timer A times-out and the command temperature is decreased to 342° F., as shown at 74 of FIGS. 3 and 9. Timer B now begins measuring its time interval.

All copy jobs between times 73 and 76, the latter being the time-out time of timer B, will be fused at command temperatures of 342° F. for small paper (i.e. no change in command temperature) and at 350° F. for large paper.

More specifically, and with reference to FIG. 9, a copy job request 77 which is received before timer B times-out (78 of FIG. 9) establishes a command temperature of 350° F. for large paper (80 and 81 of FIG. 9). At the end of this latter copy job, 82, the command temperature returns to 342° F., as shown.

When timer B times-out, as at 83 of FIG. 9, the above-described mode of operation of FIGS. 4 and 8 is assumed.

As mentioned previously, the use of the term job end may in fact mean that all copies of a given copy job have been fused, or it can mean an anticipation of the end of the copy job, as exemplified by FIG. 5. In addition, the specific time intervals above described are exemplary only, and the present invention is to be considered to include variations of the above control systems.

As is well known, microcomputers can be used to advantage to implement control systems such as above described. It is often preferable to implement the above-described control systems by use of a programmed microprocessor which provides the same functions as FIG. 6, but requires only programming and input/output hardware to perform the complicated actions of a complex control network, which is often difficult to initially design, and difficult to change once a design has been completed.

An exemplary microcomputer for this use is that of aforementioned U.S. Pat. No. 4,170,414. Since the assembly language is written in terms of mnemonics in this patent, the details necessary to implement the present invention is supplied in Appendix A, which summarizes the instruction repertoire and includes macro instruction mnemonics.

Included herewith as Appendix B is the assembly listing for this microcomputer which implements the present invention.

APPENDIX A

| INSTRUCTION MNEMONIC | HEX VALUE | NAME | DESCRIPTION |
|---|---|---|---|
| AB(L) | A4 | Add Byte (Low) | Adds addressed operand to LACC (8-bit op.) |
| AI(L) | AC | Add Immed. (Low) | Adds address field to LACC (16-bit op.) |
| AR | DN | Add Reg. | Adds N-th register contents to ACC (16-bit op.) |
| A1 | 2E | Add One | Adds 1 to ACC (16-bit op.) |
| B | 24,28,2C | Branch | Branch to LSB (+256, −256, ±0) |
| BAL | 30–33 | Branch And Link | Used to call subroutes (PC to Reg. 0, 1, 2, or 3) |
| BE | 35,39,3D | Branch Equal | Branches if EQ set (See B) |
| BH | 36,3A,3E | Branch High | Branch if EQ and LO are reset (See B) |
| BNE | 34,38,3C | Branch Not Equal | Branch if EQ reset (See B) |
| BNL | 37,3B,3F | Branch Not Low | Branch if LO reset (See B) |
| BR | 20–23 | Branch Reg. | See RTN |
| CB(L) | A0 | Compare Byte (Low) | Addressed byte compared to LACC (8-bit op.) |
| CI(L) | A8 | Compare Immed. (Low) | Address field compared to LACC (8-bit op.) |
| CLA | 25 | Clear Acc. | ACC reset to all zeroes (16-bit op.) |
| GI | A9 | Group Immed. | Selects one of 16 register groups (also controls interrupts) |
| IC | 2D | Input Carry | Generate carry into ALU |
| IN | 26 | Input | Read into LACC from addressed device (8-bit op.) |
| J | ON,1N | Jump | Jump (forward or back) to PC(15–4),N |
| JE | 4N,5N | Jump Equal | Jump if EQ set (See J) |
| JNE | 6N,7N | Jump Not Equal | Jump if EQ reset (See J) |
| LB(L) | A6 | Load Byte (L) | Load addressed byte into LACC (8-bit op.) |
| LI | AE | Load Immed. | Load address field into LACC |
| LN | 98–9F | Load Indirect | Load byte addressed by reg. 8-F into LACC (8-bit op.) |
| LR | EN | Load Register | Load register N into ACC (16-bit op.) |
| LRB | FN | Load Reg./ Bump | Load reg. N into ACC and increment; ACC to Reg. N (N = 4–7,C–F) (16-bit op.) |
| LRD | FN | Load Reg./Decr. | Load reg. N into ACC and decrement; ACC to Reg. N (N = 0–3,8–B) (16-bit op.) |
| NB(L) | A3 | And Byte (Low) | AND addressed byte into LACC (8-bit op.) |
| NI(L) | AB | And Immed.(Low) | AND address field into LACC (8-bit op.) |
| OB(L) | A7 | Or Byte (Low) | OR address byte into LACC (8-bit op.) |
| OI(L) | AF | Or Immed.(Low) | OR address field into LACC (8-bit op.) |
| OUT | 27 | Output | Write LACC to addressed device |
| RTN | 20–23 | Return | Used to return to calling program (See BAL) |
| SB(L) | A2 | Subtract Byte (Low) | Subtract addressed byte from LACC (8-bit op.) |
| SHL | 2B | Shift Left | Shift ACC one bit left (16-bit op.) |
| SHR | 2F | Shift Right | Shift ACC one bit right(16-bit op.) |
| SI(L) | AA | Subtract | Subtract address field from |

-continued

APPENDIX A

| INSTRUCTION MNEMONIC | HEX VALUE | NAME | DESCRIPTION |
|---|---|---|---|
| | | Immed.(Low) | LACC (16-bit op.) |
| SR | CN | Subtract Reg. | Subtract reg. N from ACC (16-bit op.) |
| STB(L) | A1 | Store Byte(Low) | Store LACC at address (8-bit op.) |
| STN | B8-BF | Store Indirect | Store LACC at address in Reg. 8–F |
| STR | 8N | Store Reg | Store ACC in Reg. N (16-bit op.) |
| S1 | 2A | Subtract One | Subtract 1 from ACC (16-bit op.) |
| TP | 9N | Test/Preserve | Test N-th bit in LACC (N = 0–7) |
| TR | BN | Test/Reset | Test and reset N-th bit in LACC |
| TRA | 29 | Transpose | Interchange HACC and LACC |
| XB(L) | A5 | XOR Byte (Low) | Exclusive-OR addressed byte into LACC (8-bit op.) |
| XI(L) | AD | XOR Immed. (Low) | Exclusive-OR address field into LACC (8-bit op.) |

Notes:
ACC (Accumulator) is 16-bit output register from arithmetic-logic unit
- LACC signifies herein the low ACC byte; HACC, the high byte
- all single byte operations are into low byte
- register operations are 16-bit (two-byte)
- 8-bit operations do not affect HACC
EQ (equal) is a flag which is set:
if ACC = 0 after register AND or XOR operations;
if ACC (low byte) = 0 after single byte operation;
if a tested bit is 0;
if bits set by OR were all 0's;
if input carry = 0;
if compare operands are equal;
if bit shifted out of ACC = 0;
if 8th bit of data during IN or OUT = 0.
LO (low) is a flag which is set: (always reset by IN, OUT, IC)
if ACC bit 16 = 1 after register operation;
if ACC bit 8 = 1 after single byte operations;
if logic operation produces all ones in LACC;
if all bits other than tested bit = 0;
if ACC = 0 after shift operation;
if compare operand is greater than ACC low byte.

| MACRO MNEMONIC | NAME | DESCRIPTION |
|---|---|---|
| BC | Branch on Carry | Branches if carry is set |
| BCT | Branch on Count | Reg. decremented and branch if not zero result |
| BHA | Branch on High ACC | Used after compare |
| BL | Branch on Low | Branches if LO is set |
| BLA | Branch on Low ACC | See BNC; used after compare |
| BNC | Branch Not Carry | Branches if carry is reset |
| BNLA | Branch on Not Low ACC | See BC; used after compare |
| BNZ | Branch Not Zero | Branches if previous result was not zero |
| BR | Branch via Register | Same as RTN instruction |
| BU | Branch Unconditionally | Same as BAL instruction |
| CIL | Compare Immed. Low | Uses low byte of indicated constant in CI address field |
| DC | Define Constant | Reserves space for constant |
| EXP2 | Express In powers of 2 | Opcode set to binary |
| JC | Jump on Carry | See BC |
| JL | Jump on Low | See BL |
| JNC | Jump on No Carry | See BNC |
| JNH | Jump Not High | See BNH |
| LA | Load Address | Generates sequence LIH, TRA, LIL |
| LBD | Load Byte Double | Bytes at addr. and addr. +1 to ACC |
| LID | Load Immed. Double | Same as LA |

-continued

| MACRO MNEMONIC | NAME | DESCRIPTION |
|---|---|---|
| LIH | Load Immed. High | Uses high byte of constant in LI address field |
| LIL | Load Immed. Low | Uses low byte of constant in LI address field |
| NOP | No Operation | Dummy instruction - skipped |
| RAL | Rotate ACC Left | Generates sequence SHL, IC, A1 |
| SCTI | Set Count Immed. | Generates CLA, LI, STR |
| SHLM | Shift Left Multiple | Shifts specified number of times to left |
| SHRM | Shift Right Multiple | Shifts specified number of times to right |
| SRG | Set Register Group | Same as GI |
| STDB | Store Byte Double | ACC to addr. +1 and addr. |
| TPB | Test & Preserve Bit | Generates sequence LB, TP |
| TRB | Test & Reset Bit | Generates sequence LB, TR, STB |
| TRMB | Test & Reset Multiple Bits | Same as TRB but specifies multiple bits |
| TRMR | Test/Reset Mult. Bits in Reg. | Generates LR, NI, STR |
| TS | Test and Set | Same as OI instruction |
| TSB | Test & Set Byte | Same as TS but byte is specified in addition to bit |
| TSMB | Test & Set Multiple Bytes | Same as TS but specifies multiple Bits |
| TSMR | Test & Set Mult. Bits in Reg. | Generates LR, OI, STR |
| LZI | Zero & Load | Generates CLA, LI |

-continued

| MACRO MNEMONIC | NAME | DESCRIPTION |
|---|---|---|
| | Immed. | |

NOTES:
(Label) DC * causes the present location (*) to be associated with the label.
L and H, in general, are suffixes indicating low or high byte when 16 bit operands are addressed.

APPENDIX B

```
        ISEG   NEWHOTFU                                                    B1
*
*                          BEGIN SEGMENT (NEWHOTFU)
*                          1. TEXT
*                               THIS ROUTINE MONITORS THE TIME
*                               REQUIRED FOR THE FUSER TEMP. TO REACH
*                               THE CONTROLLED POINT AND IF THE
*                               TIME IS GREATER THAN (5 MIN AT
*                               60HZ OR 6 MIN AT 50HZ) THEN THE
*                               CONTROLLED POINT IS SET TO HIGH
*                               TEMPERATURE AND HOLDTEMP FLAG IS
*                               SET TO KEEP THE CONTROLLED POINT
*                               HIGH FOR APPROX 30 MINUTES.
*                               IF THE TIME TO REACH CONTROLLED
*                               POINT IS LESS THEN (5-6 MINUTES)
*                               THEN THE CONTROLLED POINT IS SET
*                               TO LOW TEMPERATURE.
**   ---------------------------------------------------------------
**                         ****** TIMINGS ******
**
**
**   HOTFUSER  ..:12MIN : 12MIN : 12MIN : 12MIN : 12MIN : ...............
**
**   TIME1FLG  .........:       :       :       :
**                      :       :       :       :
**   TIME2FLG  ..........................:       :
**                                       :       :
**   HOLDTEMP  ..: T1 = 24MIN  :
**
**   MODRTEMP  ................:       T2 = 36MIN       :
*
*                          1. ENDTEXT;
*                          1. IF FSRPLSB
        GI     INTOFFCG+BASERG
        LB     PSB19
        TP     FSRPLSB
        SRG    ECCARDG
        BZ     HOT004
*
*                          1. THEN
*                          2. . IF OFFSTIND & -OSHLDFLG
        TPB    ECPCB08,OFFSTIND
        JZ     HOT000
        TPB    FLGDREGL,OSHLDFLG
        JNZ    HOT000
*
*                          2. . THEN
*                          3. . . JUMP AROUND INCRIMENTOR;
        B      HOT010
HOT000  DC     *
*
*                          2. . ELSE
*                          3. . . IF HOLDTEMP OR HOTTIMER = (5-6MIN)
        LB     FLGBREGH
        TP     HOLDTEMP
        JNZ    HOT001
        LR     HOTTIMER
        CI     0

        BNE    HOT002                                                      B2
        TRA
        CI     X'48'          * 5MIN @ 60HZ/ 6MIN @ 50HZ
        JE     HOT001
        J      HOT002
HOT001  DC     *
*
*                          3. . . THEN
*                          4. . . . SET HOLDTEMP;
        LB     FLGBREGH
        TS     HOLDTEMP
        STB    FLGBREGH
*
*                          4. . . . RESET HOTTIMER;
        CLA
        STR    HOTTIMER
*
*                          4. . . . RESET TIME1FLG,TIME2FLG,MODRTEMP;
        LR     FLAGCREG
        NI     X'86'
```

-continued

APPENDIX B

```
          STR   FLAGCREG
          B     HOT010
HOT002    DC    *
*                          3. . . ELSE
*                          4. . . . INCRIMENT HOTTIMER;
          LR    HOTTIMER
          A1
          STR   HOTTIMER
*                          4. . . . IF -OFFSTIND
          TPB   ECPCB08,OFFSTIND
          BNZ   HOT010
*                          4. . . . THEN
*                          5. . . . . SET OSHLDFLG;
          TSB   FLGDREGL,OSHLDFLG
          B     HOT010
*                          4. . . . ENDIF;
*                          3. . . ENDIF;
*                          2. . ENDIF;
HOT004    DC    *
*                          1. ELSE
*                          2. . RESET OSHLDFLG;
          TRB   FLGDREGL,OSHLDFLG
*                          2. . IF HOLDTEMP OR MODRTEMP
          LB    FLGBREGH
          TP    HOLDTEMP
          JNZ   HOT004C
          LR    FLAGCREG
          TP    MODRTEMP
          BZ    HOT008
*                          2. . THEN
*                          3. . . IF HOTTIMER = (12MIN-15MIN)
HOT004C   DC    *
          LR    HOTTIMER
          CI    0
          BNE   HOT006
          TRA
          CI    X'BO'
          BNE   HOT006
*                          3. . . THEN                                    B3
*                          4. . . . RESET HOTTIMER;
          CLA
          STR   HOTTIMER
*                          4. . . . IF TIME1FLG
          LB    FLGCREGL
          TR    TIME1FLG
          BZ    HOT005
*                          4. . . . THEN
*                          5. . . . . RESET TIME1FLG;
          STB   FLGCREGL
*                          5. . . . . RESET HOLDTEMP;
          TRB   FLGBREGH,HOLDTEMP
*                          5. . . . . IF MODRTEMP
          LR    FLAGCREG
          TR    MODRTEMP
          JZ    HOT004A
*                          5. . . . . THEN
*                          6. . . . . . IF TIME2FLG
          TR    TIME2FLG
          JZ    HOT004B
*                          6. . . . . . THEN
*                          7. . . . . . . RESET TIME2FLG,MODRTEMP,
*                                              TIME1FLG;
          TR    TIME1FLG
          STR   FLAGCREG
*                          6. . . . . . ELSE
*                          7. . . . . . . SET TIME2FLG;
HOT004B   DC    *
          TS    TIME2FLG
          STR   FLAGCREG
*                          6. . . . . . ENDIF;
          B     HOT006
*                          5. . . . . ELSE
HOT004A   DC    *
*                          6. . . . . . SET MODRTEMP;
          TS    MODRTEMP
          STR   FLAGCREG
*                          5. . . . . ENDIF;
          J     HOT006
HOT005    DC    *
*                          4. . . . ELSE
```

-continued

APPENDIX B

```
*                                   5. . . . . SET TIME1FLG;
            TS      TIME1FLG
            STB     FLGCREGL
*                                   4. . . . ENDIF;
HOT006      DC      *
*                                   3. . . ELSE
*                                   4. . . . INCRIMENT HOTTIMER;
            LR      HOTTIMER
            A1
            STR     HOTTIMER
            J       HOT010
*                                   3. . . ENDIF;
*                                   2. . ELSE

HOT008      DC      *                                                   B4
*                                   3. . . RESET HOTTIMER
            CLA
            STR     HOTTIMER
*                                   3. . . RESET TIME1FLG,TIME2FLG;
            LR      FLAGCREG
            TR      TIME1FLG
            TR      TIME2FLG
            STR     FLAGCREG
HOT010      DC      *
            GI      INTON
*                                   2. . ENDIF;
*                                   1. ENDIF;
*                                     ENDSEGMENT (NEWHOTFU);
            IEND    NEWHOTFU

            ISEG    NEWFUSER                                            B5
*                                   BEGINSEGMENT (NEWFUSER)
*                                   1.   TEXT
*                                        THIS SEGMENT KEEPS THE FUSER TEMP
*                                        LOW UNTIL DRIVE STARTS, THEN IF
*                                        > 12 INCH PAPER IS DETECTED LOW TEMP
*                                        IS RESET.NEAR THE END OF THE JOB
*                                        LOW TEMP IS AGAIN SET(COLDNFLG)
*                                        LIGHTCOPY INDICATOR RESETS LOW TEMP.
*                                        AND OVERRIDES PAPER SIZE CONTROL.
*
*                                          ADDED LATER: A 'HOTTIMER'
*                                          THE 'HOTTIMER' TIMES TWO EVENTS,
*                                        (A). THE TIME AFTER POR FOR THE FUSER
*                                             TO REACH OPERATING TEMPERATURE.
*                                        (B). A FIXED TIME (APPROX. 30 MIN.)
*                                             DURING WHICH HOLDTEMP FLAG IS SET.
*
*                                        ADDED MUCH LATER: 5 LEVEL CONTROL
*                                        THE TEMPERATURE OF THE FUSER IS NOW
*                                        A FUNCTION OF HOLDTEMP FLAG AND
*                                        PAPER SIZE. ALSO, ADDED WAS A 5TH
*                                        TEMPERATURE FOR OFFSET MASTERS IF
*                                        SELECTED.
**
**
*                                   TIMINGS
*
*
*    HT1  HT2  LT  DEG
*
*     1    1    0   366
*     0    1    0   358
*     1    0    0   350
*     0    0    0   342
*     0    0    1   334
*
*
*
```

-continued

APPENDIX B

```
          BAL   R0,ECPLC47
ECPLC07   DC    *
          SRG   BASERG
*                          1. THEN
*                          2. . IF (DRIVE)
                                                                    B6
          TPB   PSB21,DRIVE
          BZ    ECPLC33
*                          2. . THEN
*                          3. . . IF SEPARIND & PLSSTBY & –FLUSH
          LB    PCB06
          TP    SEPARIND
          BZ    ECPLC15
          LB    PCB13
          TP    PLSSTBY
          BZ    ECPLC15
          LB    PSB07
          TP    FLUSH
          BNZ   ECPLC15
*                          3. . . THEN
**        ..... NEWFUSER 5TH LEVEL CONTROL ADDITION 5 .....
*                          4. . . . IF HOLDTEMP
          SRG   ECCARDRG
          LR    FLAGBREG
          TRA
          TP    HOLDTEMP
          TRA
          JZ    ECPLC10
*                          4. . . . THEN
*                          5. . . . . RESET LTEMPFLG,HITP1FLG;
          NI    X'3F'
*                          5. . . . . SET HITP2FLG;
          TS    HITP2FLG
          STR   FLAGBREG
          B     ECPLC12
ECPLC10   DC    *
*                          4. . . . ELSE
*                          5. . . . IF MODRTEMP
          LR    FLAGCREG
          TP    MODRTEMP
          LR    FLAGBREG
          JZ    ECPLC10A
*                          5. . . . . THEN
*                          6. . . . . . RESET LTEMPFLG,HITP2FLG;
          TR    LTEMPFLG
          TR    HITP2FLG
*                          6. . . . . . SET HIRP1FLG;
          TS    HITP1FLG
          STR   FLAGBREG
          J     ECPLC12
*                          5. . . . . ELSE
ECPLC10A  DC    *
*                          6. . . . . . RESET
*                                LTEMPFLG,HITP1FLG,HITP2FLG;
          NI    X'2F'
          STR   FLAGBREG
*                          5. . . . . ENDIF;
*                          4. . . . ENDIF;
ECPLC12   DC    *
**        ..... BOTTOM OF ADDITION .....
          B     ECPLC40
                                                                    B7
ECPLC15   DC    *
*                          4. . . . IF END
          LB    PSB03
          TP    END
          SRG   ECCARDRG
          JZ    ECFLC16
*                          4. . . . THEN
*                          5. . . . . SET END1FLG;
          LR    FLAGBREG
          TS    END1FLG
          STR   FLAGBREG
          J     ECPLC17
*                          4. . . . ELSE
*                          5. . . . . IF END1FLG
ECPLC16   DC    *
          LR    FLAGBREG
          TR    END1FLG
          JZ    ECPLC17
```

-continued

APPENDIX B

```
*                                   5. . . . . THEN
*                                   6. . . . . . RESET END1FLG,
*                                           DRVFLG,FENDFLG,COLDNFLG;
          STR    FLAGBREG
          TRMR   FLAGAREG,P(DRVFLG,FENDFLG,COLDNFLG)
*                                   5. . . . . ENDIF;
*                                   4. . . . ENDIF;
*                                   4. . . . IF (DRVFLG)
ECPLC17   DC     *
          LR     FLAGAREG
          TP     DRVFLG
          BZ     ECPLC30
*                                   4. . . . THEN
          SRG    INTHRG
*                                   5. . . . . IF (CR2 & EC7)
          TPB    CRL0,CR2
          BZ     ECPLC25
          LB     ECCOUNT
          CI     7
          BNE    ECPLC25
*                                   5. . . . . THEN

*                                   6. . . . . . IF - (SIZEE | SIZED | (SIZEC
*                                           & -B4))
          SRG    INTHRG
          LB     SIZE
          NI     P(SIZEE,SIZED)
          BNZ    ECPLC24
          LB     SIZE
          TP     SIZEC
          JZ     ECPLC20
          LBL    COUNTRY
          TP     B4
          BZ     ECPLC24
ECPLC20   DC     *
*                                   6. . . . . . THEN
**      ........................NEWFUSER 5TH LEVEL CONTROL ADDITION 1A & B ................
*                                   7. . . . . . . IF HOLDTEMP
                                                                                          B8
          SRG    ECCARDRG
          LR     FLAGBREG
          TRA
          TP     HOLDTEMP
          TRA
          JZ     ECPLC021
*                                   7. . . . . . . THEN
*                                   8. . . . . . . . RESET HITP2FLG,LTEMPFLG;
          TR     HIRP2FLG
          TR     LTEMPFLG
*                                   8. . . . . . . . SET HIRP1FLG;
          TS     HITP1FLG
          STR    FLAGBREG
          B      ECPLC25
*                                   7. . . . . . . ELSE
ECPLC021  DC     *
*                                   8. . . . . . . . IF MODRTEMP
          LR     FLAGCREG
          TP     MODRTEMP
          LR     FLAGBREG
          JZ     ECPLC21A
*                                   8. . . . . . . . THEN
*                                   9. . . . . . . . . RESET LTEMPFLG,
*                                           HITP1FLG,HITO2FLG;
          NI     X'2F'
          STR    FLAGBREG
          J      ECPLC21B
ECPLC21A  DC     *
*                                   8. . . . . . . . ELSE
*                                   9. . . . . . . . . RESET HITP1FLG,
*                                           HITP2FLG;
          TR     HITP1FLG
          TR     HITP2FLG
*                                   9. . . . . . . . . SET LTEMPFLG;
          TS     LTEMPFLG
          STR    FLAGBREG
ECPLC21B  DC     *
          B      ECPLC25
*                                   8. . . . . . . . ENDIF;
*                                   7. . . . . . . ENDIF;
*                                   6. . . . . . ELSE
```

-continued

APPENDIX B

```
ECPLC24   DC    *
*                                7..... IF HOLDTEMP
          SRG   ECCARDRG
          LR    FLAGBREG
          TRA
          TP    HOLDTEMP
          TRA
          JZ    ECPLC24B
*                                7..... THEN
*                                8........ RESET LTEMPFLG,HITP1FLG;
          TR    LTEMPFLG
          TR    HITP1FLG
*                                8........ SET HITP2FLG;
          TS    HITP2FLG
                                                                          B9
          STR   FLAGBREG
          B     ECPLC25
*                                7..... ELSE
ECPLC24B  DC    *
*                                8........ IF MODRTEMP
          LR    FLAGCREG
          TP    MODRTEMP
          LR    FLAGBREG
          JZ    ECPLC24C
*                                8........ THEN
*                                9......... RESET LTEMPFLG,
*                                              HITP2LFG;
          TR    LTEMPFLG
          TR    HITP2FLG
*                                9......... SET HITP1FLG;
          TS    HITP1LFG
          STR   FLAGBREG
          J     ECPLC25
*                                8........ ELSE
ECPLC24C  DC    *
*                                9......... RESET LTEMPFLG,
*                                              HITP1LFG HITP2FLG;
          NI    X'2F'
          STR   FLAGBREG
*                                8........ ENDIF;
*                                7..... ENDIF;
**
.......................BOTTOM OF addition ..............................................
*                                6..... ENDIF;
*                                5.... ENDIF;
ECPLC25   DC    *
*                                5.... CALL (BCDTOBIN) CPYCTR;
          SRG   INTHRG
          LR    CPYCTR
          SRG   ECCARDRG
          BAL   TEMPREG,ECBCDBIN
          SR    COPYREG
*                                5.... ADJUST CPYCTR BY COPYREG;
          STR   CNTLREG
*                                5.... IF (–FENDFLG)
          LR    FLAGAREG
          TP    FENDFLG
          SRG   INTHRG
          LR    CPYSLCT
          SRG   ECCARDRG
          JNZ   ECPLC28
*                                5.... THEN
*                                6..... CALL (BCDTOBIN) CPYSLCT;
          BAL   TEMPREG,ECBCDBIN
          SR    COPYREG
          SHR
*                                6..... ADJUST CPYSLCT BY COPYREG;
          J     ECPLC29
*                                5.... ELSE
ECPLC28   DC    *
*                                6..... CPYCTR + 10) TO CNTLREG;
                                                                          B10
          LR    CNTLREG
          AI    10
          STR   CNTLREG
          SRG   INTHRG
          LR    CPYSLCT
          SRG   ECCARDRG
*                                6..... CALL (BCDTOBIN) CPYSLCT;
          BAL   TEMPREG,ECBCDBIN
*                                6..... ADJUST CPYSLCT BY COPYREG;
```

-continued

APPENDIX B

```
            SR      COPYREG
*                                   5. . . . . ENDIF;
ECPLC29     DC      *
*                                   5. . . . . IF (ACC-CNTLREG=0)
            SR      CNTLREG
            JNE     ECPLC29A
*                                   5. . . . . THEN
*                                   6. . . . . . SET COLDNFLG;
            LR      FLAGAREG
            TS      COLDNFLG
            STR     FLAGAREG
*                                   5. . . . . ENDIF;
ECPLC29A    DC      *
*                                   5. . . . . IF COLDNFLG & (CPYCTR-=0) &
*                                                  -ORGATDF
            LR      FLAGAREG
            TP      COLDNFLG
            BZ      ECPLC40
            SRG     INTHRG
            LR      CPYCTR
            CI      0
            BE      ECPLC40
            LB      CSB09
            TP      ORGATDF
            BNZ     ECPLC40
            SRG     ECCARDRG
*                                   5. . . . . THEN
**
      ..........................NEWFUSER 5TH LEVEL CONTROL ADDITION 2 ................
*                                   6. . . . . . IF HOLDTEMP
            SRG     ECCARDRG
            LR      FLAGBREG
            TRA
            TP      HOLDTEMP
            TRA
            JZ      ECPLC29B
*                                   6. . . . . . THEN
*                                   7. . . . . . . RESET LTEMPFLG,HITP2FLG;
            TR      LTEMPFLG
            TR      HITP2FLG
*                                   7. . . . . . . SET HITP1FLG;
            TS      HITP1FLG
            STR     FLAGBREG
            B       ECPLC29E
*                                   6. . . . . . ELSE
ECPLC29B    DC      *
*                                   7. . . . . . . IF MODRTEMP
                                                                                B11
            LR      FLAGCREG
            TP      MODRTEMP
            LR      FLAGBREG
            JZ      ECPLC29C
*                                   7. . . . . . . THEN
*                                   8. . . . . . . . RESET LTEMPFLG,HITP1FLG,
*                                                        HITP2FLG;
            NI      X'2F'
            STR     FLAGBREG
            J       ECPLC29E
*                                   7. . . . . . . ELSE
ECPLC29C    DC      *
*                                   8. . . . . . . . RESET HITP1FLG,HITP2FLG,;
            TR      HITP1FLG
            TR      HITP2FLG
*                                   8. . . . . . . . SET LTEMPFLG;
            TS      LTEMPFLG
            STR     FLAGBREG
ECPLC29E    DC      *
*                                   7. . . . . . . ENDIF;
*                                   6. . . . . . ENDIF;
**
      ..........................BOTTOM OF ADDITION ........................................
*                                   5. . . . . ENDIF;
*                                   4. . . . ELSE
            B       ECPLC40
ECPLC30     DC      *
*                                   5. . . . . SET DRVFLG;
            TS      DRVFLG
            STR     FLAGAREG
**
      ..........................NEWFUSER 5TH LEVEL CONTROLSDDITION 4.....................
*                                   5. . . . . RESET LTEMPFLG,HITP2FLG;
            LR      FLAGBREG
            TR      LTEMPFLG
```

-continued

APPENDIX B

```
          TR      HITP2FLG
*                                 5. . . . . SET HITP1FLG;
          TS      HITP1FLG
          STR     FLAGBREG
**   ..........................BOTTOM OF ADDITION ..........................................
*                                 5. . . . . IF ((CPYSLCT-CPYCTR) <19)
          SRG     INTHRG
          LR      CPYCTR
          SRG     ECCARDRG
          BAL     TEMPREG,ECBCDBIN
          STR     COPYREG
          SRG     INTHRG
          LR      CPYSLCT
          SRG     ECCARDRG
          BAL     TEMPREG,ECBCDBIN
          SR      COPYREG
          AI      X'EC'
          TRA
          AI      X'03'
          TP      BIT2
          BZ      ECPLC40
*                                 5. . . . . THEN
                                                                                          B12
*                                 6. . . . . . SET FENDFLG;
          LR      FLAGAREG
          TS      FENDFLG
          STR     FLAGAREG
          B       ECPLC40
*                                 5. . . . . ENDIF;
*                                 4. . . . ENDIF;
*                                 3. . . ENDIF;
*                                 2. . EDNIF;
*                                 3. . . RESET DRVFLG & FENDFLG & COLDNFLG;
ECPLC33   DC      *
          SRG     ECCAEDRG
          TRMR    FLAGAREG,P(DRVFLG,FENDFLG,COLDNFLG)
**   ..........................NEWFUSER 5TH LEVEL CONTROL ADDITION 3 ....................
*                                 3. . . IF HOLDTEMP
          LR      FLAGBREG
          TRA
          TP      HOLDTEMP
          TRA
          JZ      ECPLC35
*                                 3. . . THEN
*                                 4. . . . RESET LTEMPFLG,HITP2FLG;
          TR      LTEMPFLG
          TR      HITP2FLG
*                                 4. . . . SET HITP1FLG;
          TS      HITP1FLG
          STR     FLAGBREG
          B       ECPLC36
ECPLC35   DC      *
*                                 3. . . ELSE
*                                 4. . . . IF MODRTEMP
          LR      FLAGCREG
          TP      MODRTEMP
LR        FLAG-
          BREG
          JZ      ECPLC35A
*                                 4. . . . THEN
*                                 5. . . . . RESET HITP1FLG,HITP2FLG,
*                                                 LTEMPFLG;
          NI      X'2F'
          STR     FLAGBREG
          J       ECPLC36
ECPLC35A  DC      *
*                                 5. . . . . RESET HITP1FLG,HITP2FLG;
          TR      HITP1FLG
          TR      HITP2FLG
*                                 5. . . . . SET LTEMPFLG;
          TS      LTEMPFLG
          STR     FLAGBREG
*                                 4. . . . ENDIF;
*                                 3. . . ENDIF;
ECPLC36   DC      *
**   ..........................BOTTOM OF ADDITION.........................................
*                                 3. . . RESET END1FLG;
          TR      END1FLG
          STR     FLAGBREG
```

-continued

APPENDIX B

```
*                                   2. . ENDIF;
ECPLC40     DC      *
**      ..........................NEWFUSER 5TH LEVEL CONTROL ADDITION 8 ....................
*                                   2. . IF LTEMPFLG
            SRG     ECCARDRG
            LR      FLAGBREG
            TP      LTEMPFLG
            JZ      ECPLC42
*                                   2. . THEN
*                                   3. . . SET LOWTEMP;
            SRG     BASERG
            TSB     PCB02,LOWTEMP
            J       ECPLC43
*                                   2. . ELSE
*                                   3. . . RESET LOWTEMP;
ECPLC42     DC      *
            SRG     BASERG
            TRB     PCB02,LOWTEMP
*                                   2. . ENDIF;
ECPLC43     DC      *
*                                   2. . IF HITP1FLG
            SRG     ECCARDRG
            LR      FLAGBREG
            TP      HITP1FLG
            JZ      ECPLC44
*                                   2. . THEN
*                                   3. . . SET HITEMP1;
            TSB     ECPCB08,HITEMP1
            J       ECPLC45
ECPLC44     DC      *
*                                   2. . ELSE
*                                   3. . . RESET HITEMP1;
            TRB     ECPCB08,HITEMP1
*                                   2. . ENDIF;
ECPLC45     DC      *
*                                   2. . IF HITP2FLG
            SRG     ECCARDRG
            LR      FLAGBREG
            TP      HITP2FLG
            JZ      ECPLC46
*                                   2. . THEN
*                                   3. . . SET HITEMP2;
            TSB     ECPCB08,HITEMP2
            J       ECPLC47
ECPLC46     DC      *
*                                   2. . ELSE
*                                   3. . . RESET HITEMP2;
            TRB     ECPCB08,HITEMP2
*                                   2. . ENDIF;
ECPLC47     DC      *
*                                   2. . SET OUTPUTS;
            LB      ECPCB08
            STB     ECCB08
**      ..........................BOTTOM OF ADDITION ........................................
            GI      INTONCG+BASERG
                                                                                            B14
*                                   1. ENDIF;
*                                   ENDSEGMENT (NEWFUSER);
            IEND
            NEW-
            FUSER
```

While the invention has been particularly shown and described with reference to preferred embodiments thereof, it will be understood by those skilled in the art that various changes in form and details may be made therein without departing from the spirit and scope of the invention.

What is claimed is:

1. A hot roll temperature control for use with the hot roll fusing station of a xerographic reproduction device, comprising:

means responsive to an off-to-on transition of the reproduction device to institute a first active set point temperature for said fusing station;

temperature sensing means providing an output indicative of the actual temperature of said fusing station;

heating control means operable to heat said fusing station and controlled by said output and an active set point temperature;

means responsive to the time interval required for said heating control means to achieve said first active set point temperature; and means controlled by said time interval responsive means operable to institute a second active set point temperature dependent upon the length of said time interval.

2. The control system of claim 1 wherein said time interval response means is responsive to failure to achieve said first active set point temperature within a reference time interval, and said second active set point temperature is instituted upon such a failure.

3. The control system of claim 2 wherein said second active set point temperature is higher than said first active set point temperature.

4. The control system of claim 3 wherein a third active set point temperature is instituted when said time interval is shorter than said reference time interval, said third active set point temperature being less than said second active set point temperature.

5. The control system of claim 3 wherein said device is enabled for reproduction use only after an active set point temperature has been achieved, and wherein institution of said second active set point temperature causes said second active set point temperature to be maintained for a measured period of time, whereupon a third active set point temperature is instituted, said third active set point temperature being less than said second active set point temperature.

6. The control system of claims 4 or 5 wherein said reproduction device is selectively capable of use with paper of small area or paper of large area, and wherein the said first, second or third active set point temperatures, whichever is active at a given time, is increased in magnitude upon selection of the paper of large area.

7. The control system of claims 4 or 5 wherein said reproduction device is selectively capable of use with paper of small area or paper of large area, wherein the number of reproductions to be made in any given reproduction job is predetermined, wherein whichever of said first, second or third active set point temperatures is active at a given time is increased in magnitude upon selection of the paper of large area, and wherein said increase in magnitude is maintained for a time interval which is a function of the number of reproductions in the reproduction job.

8. A method of controlling the fusing temperature of a hot roll fuser and maintaining an associated reproduction device not-ready until a proper fusing temperature has been achieved, comprising the steps of:

sensing a turn-on event of the reproduction device;

initiating heating of said fuser as a function of the occurrence of such an event;

maintaining the reproduction device not-ready until the fuser's temperature achieves a first lower-magnitude command temperature;

measuring a reference time interval as a function of the occurrence of such an event;

determining the fuser's actual temperature at the end of said reference time interval; and increasing the magnitude of said first command temperature upon failure to achieve said first lower-magnitude command temperature within said reference time interval.

9. The method defined in claim 8 including the step of maintaining said increased magnitude first command temperature for a second measured time interval, as said proper fusing temperature, whereupon the magnitude of said first command temperature is then reduced and thereafter becomes said proper fusing temperature.

10. The method defined in claim 9 including the steps of sensing the occurrence of a reproduction job using reproduction material requiring a greater amount of heat to properly fuse, and establishing a higher temperature during at least a portion of such a reproduction job as said proper fusing temperature.

* * * * *